US005879097A

United States Patent [19]

Cheng

[11] Patent Number: 5,879,097

[45] Date of Patent: Mar. 9, 1999

[54] RING BINDER

[75] Inventor: Ho Ping Cheng, Hong Kong, Hong Kong

[73] Assignee: World Wide Stationary Company Ltd., Hong Kong, Hong Kong

[21] Appl. No.: 627,038

[22] Filed: Apr. 3, 1996

[30] Foreign Application Priority Data

May 9, 1995 [GB] United Kingdom ..... 9509380

[51] Int. Cl.[6] ..... B42F 13/00

[52] U.S. Cl. ..... 402/26; 402/31; 402/36; 402/38

[58] Field of Search ..... 402/75, 26, 36–42; 281/36; 24/691; 411/508; D8/356, 382

[56] References Cited

U.S. PATENT DOCUMENTS

| | | | |
|---|---|---|---|
| 350,020 | 9/1886 | Shipman | 24/691 |
| 5,035,526 | 7/1991 | Cooper et al. . | |
| 5,100,253 | 3/1992 | Cooper | 402/75 |
| 5,160,209 | 11/1992 | Schuessler . | |
| 5,354,142 | 10/1994 | Yu | 402/41 |

FOREIGN PATENT DOCUMENTS

| | | | |
|---|---|---|---|
| 826276 | 12/1959 | United Kingdom . | |
| 954417 | 4/1964 | United Kingdom | 402/39 |

OTHER PUBLICATIONS

"Stimpson Eyelet Catalog", p. 86, Nov. 1968.

U.K. Search Report, 26 Apr. 1996, issued in GB 9605178.4.

*Primary Examiner*—Willmon Fridie, Jr.

*Attorney, Agent, or Firm*—Hall, Priddy & Myers

[57] ABSTRACT

A ring binder adapted to be secured to a base member, the ring binder comprising at least one securing member; a substantially rigid upper structure; a pivotable lower structure supported by the upper structure; a plurality of ring members mounted to the lower structure; and at least one engagement member engageable with the securing member closely adjacent to the base member to secure the ring binder to the base member; wherein the engagement member includes an engagement surface for engaging the securing member, the engagement surface comprising an upper surface of a partially open lower end of the engagement member, and the engagement member comprising a body which is narrower than the partially open lower end.

12 Claims, 12 Drawing Sheets

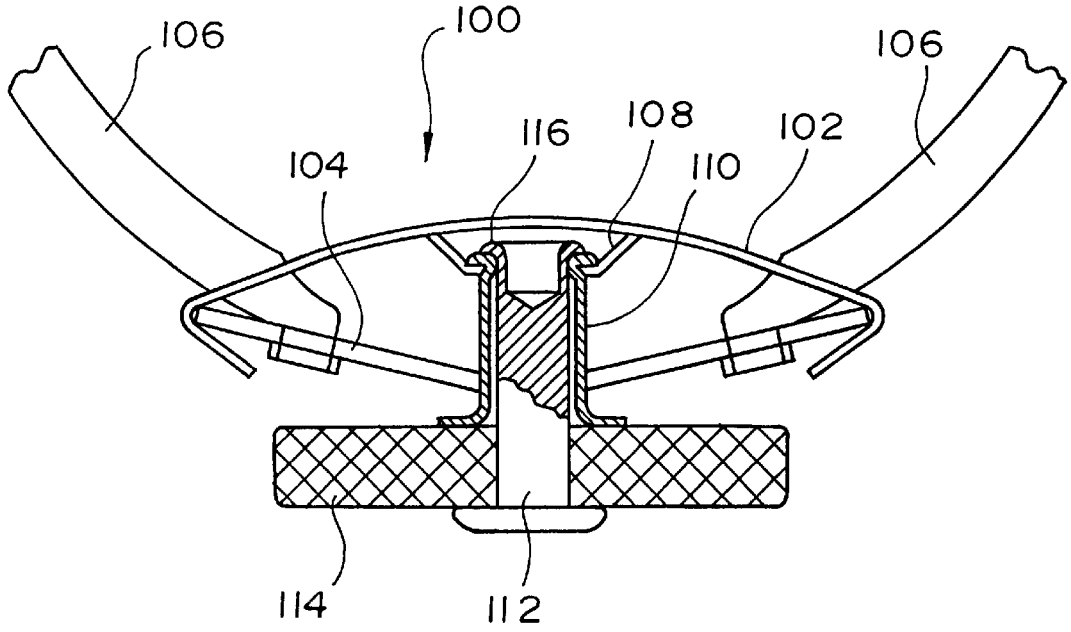
- Fig. 1A -
PRIOR ART
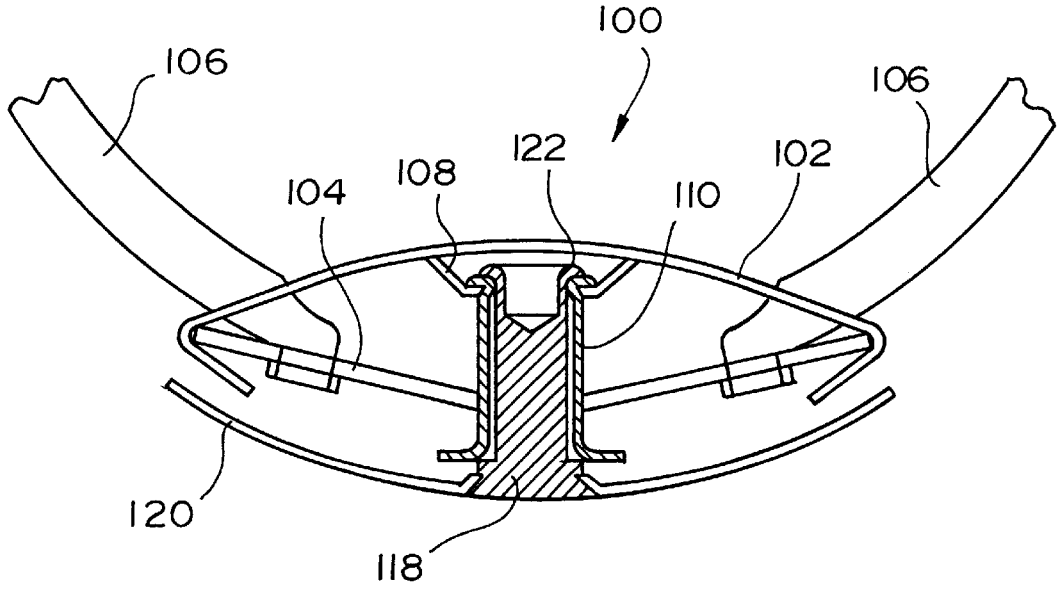
- Fig. 1B -
PRIOR ART

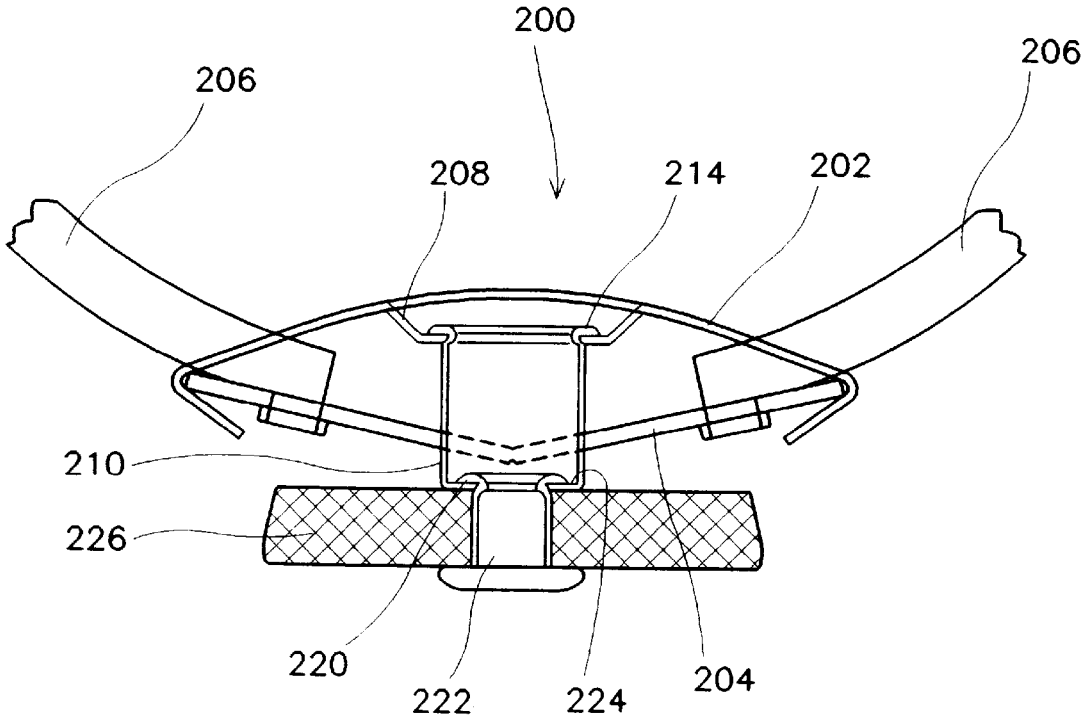
-Fig. 2A-
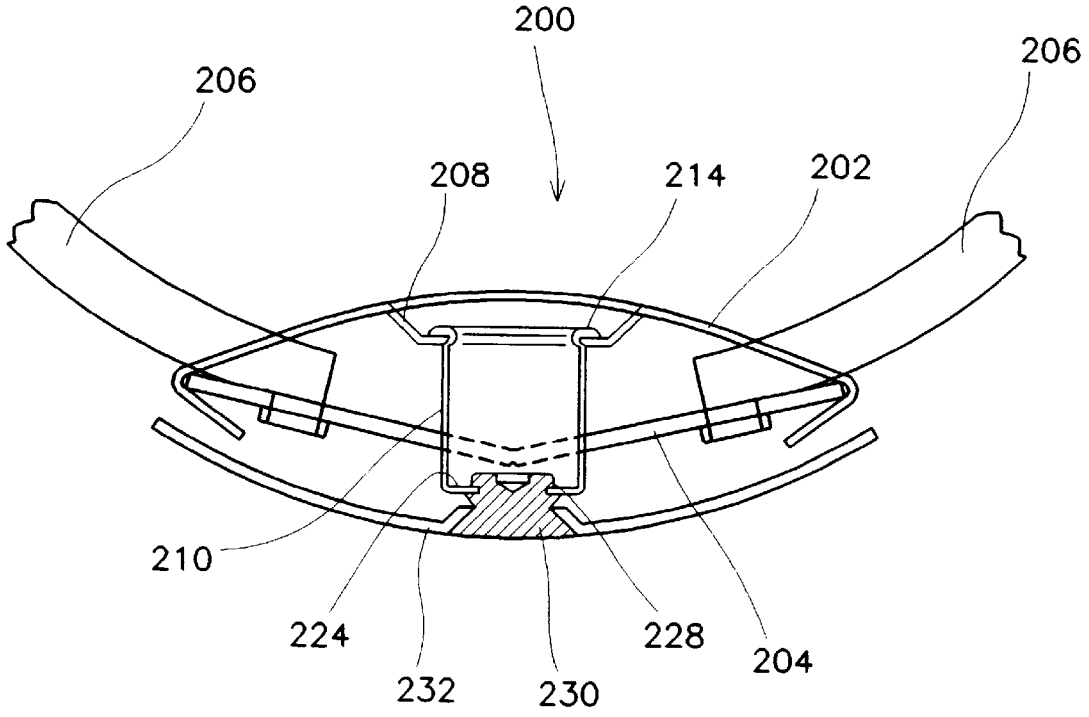
-Fig. 2B-

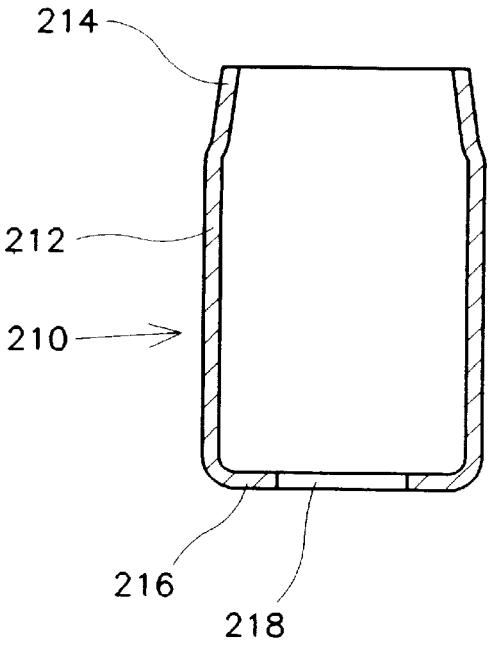
-Fig. 3A-
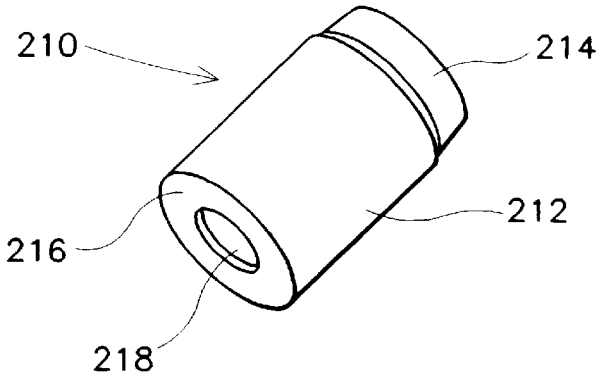
-Fig. 3B-
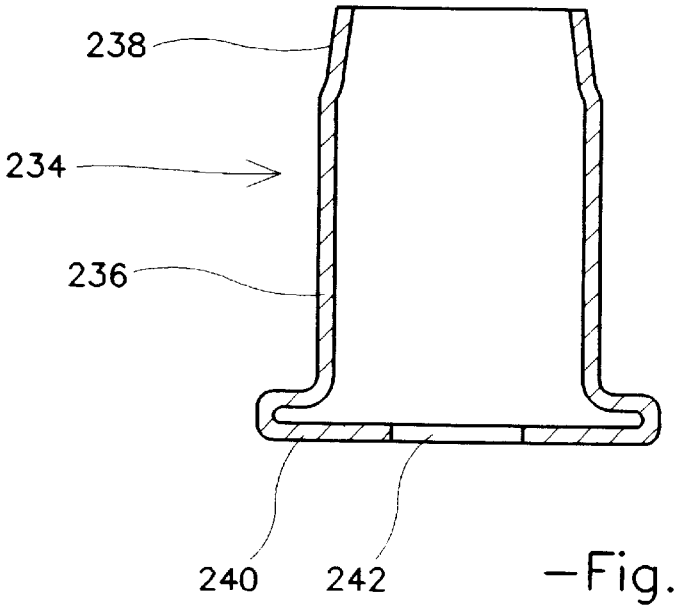
-Fig. 4-

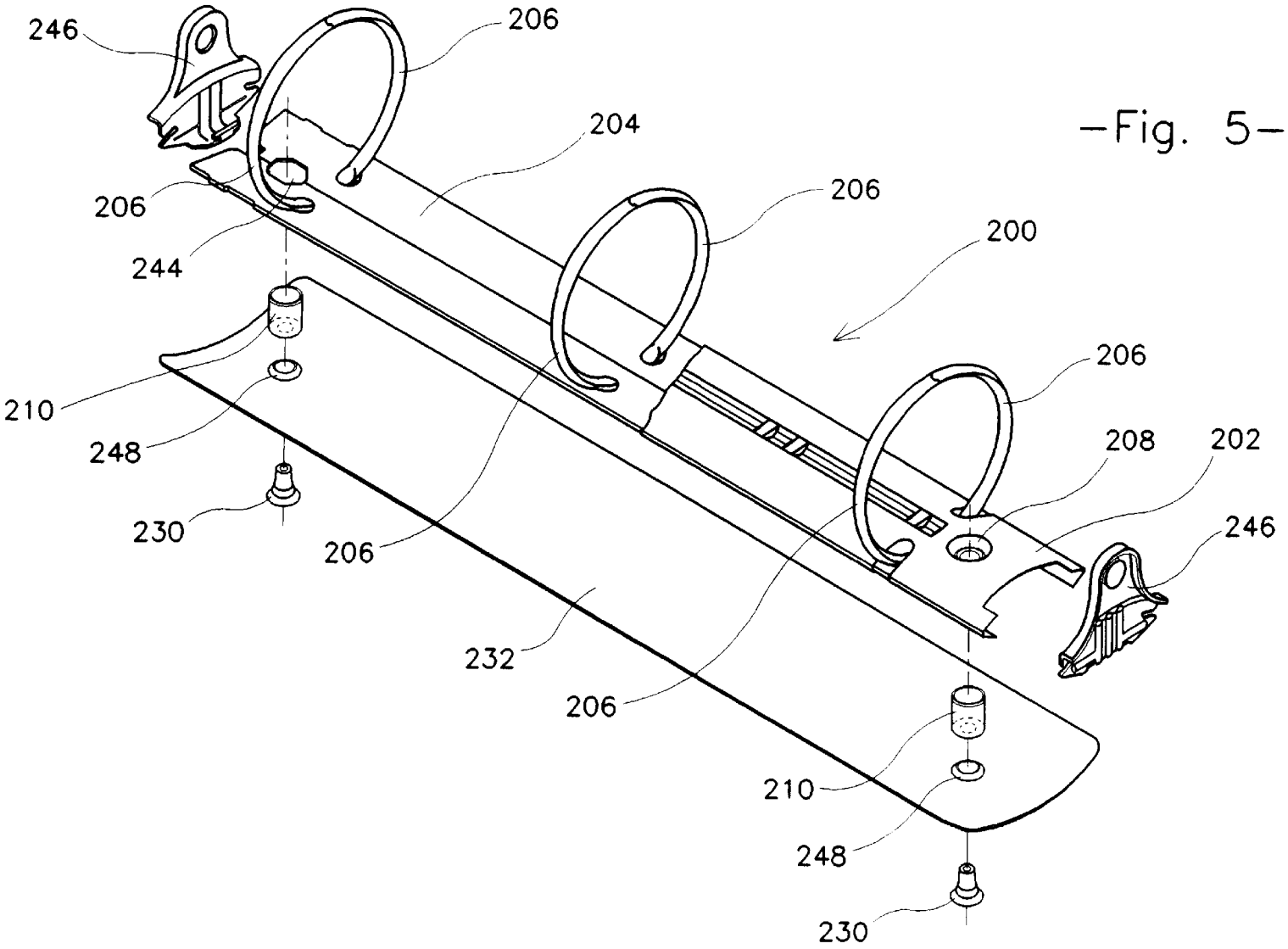
-Fig. 5-

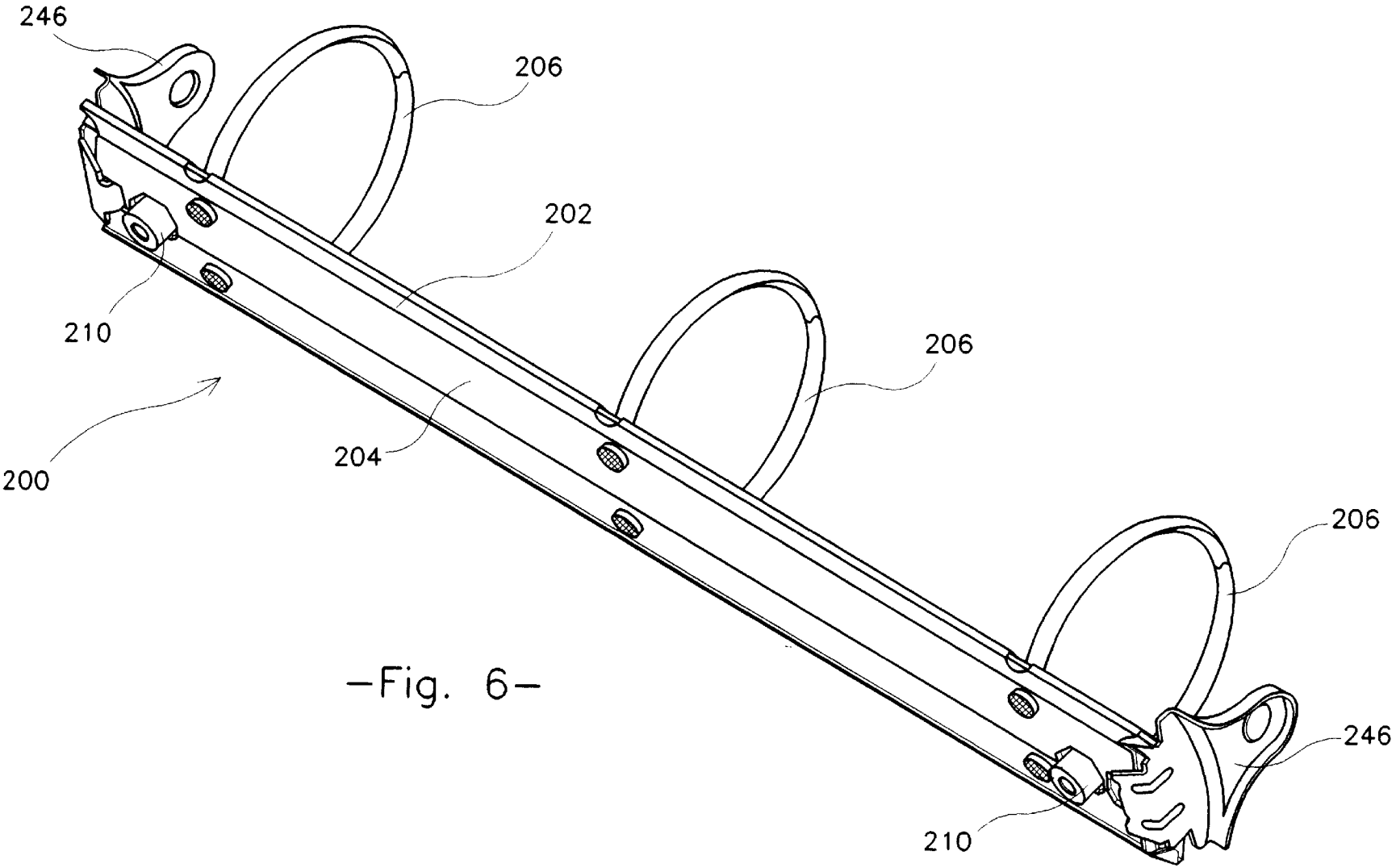
—Fig. 6—

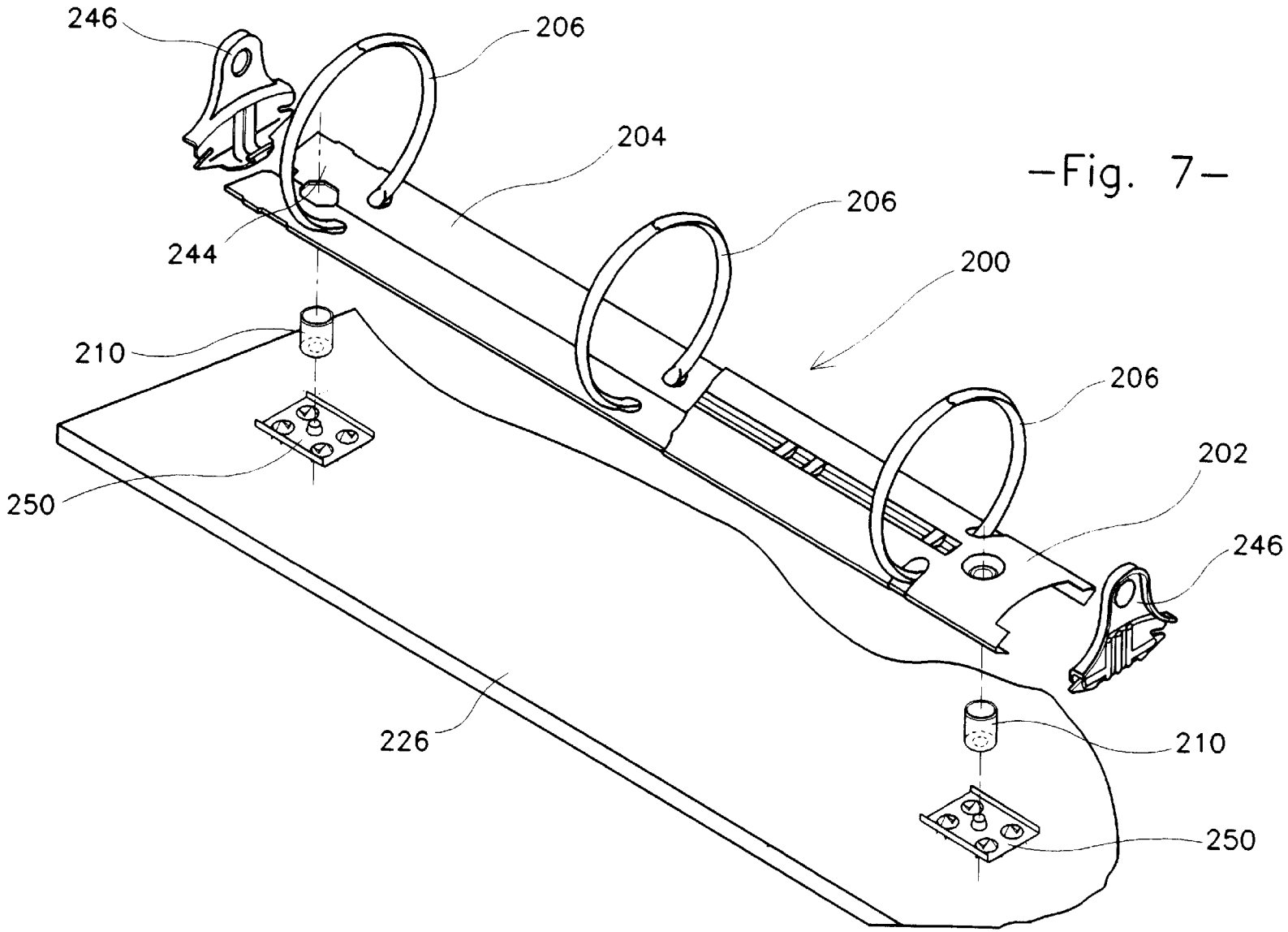
-Fig. 7-

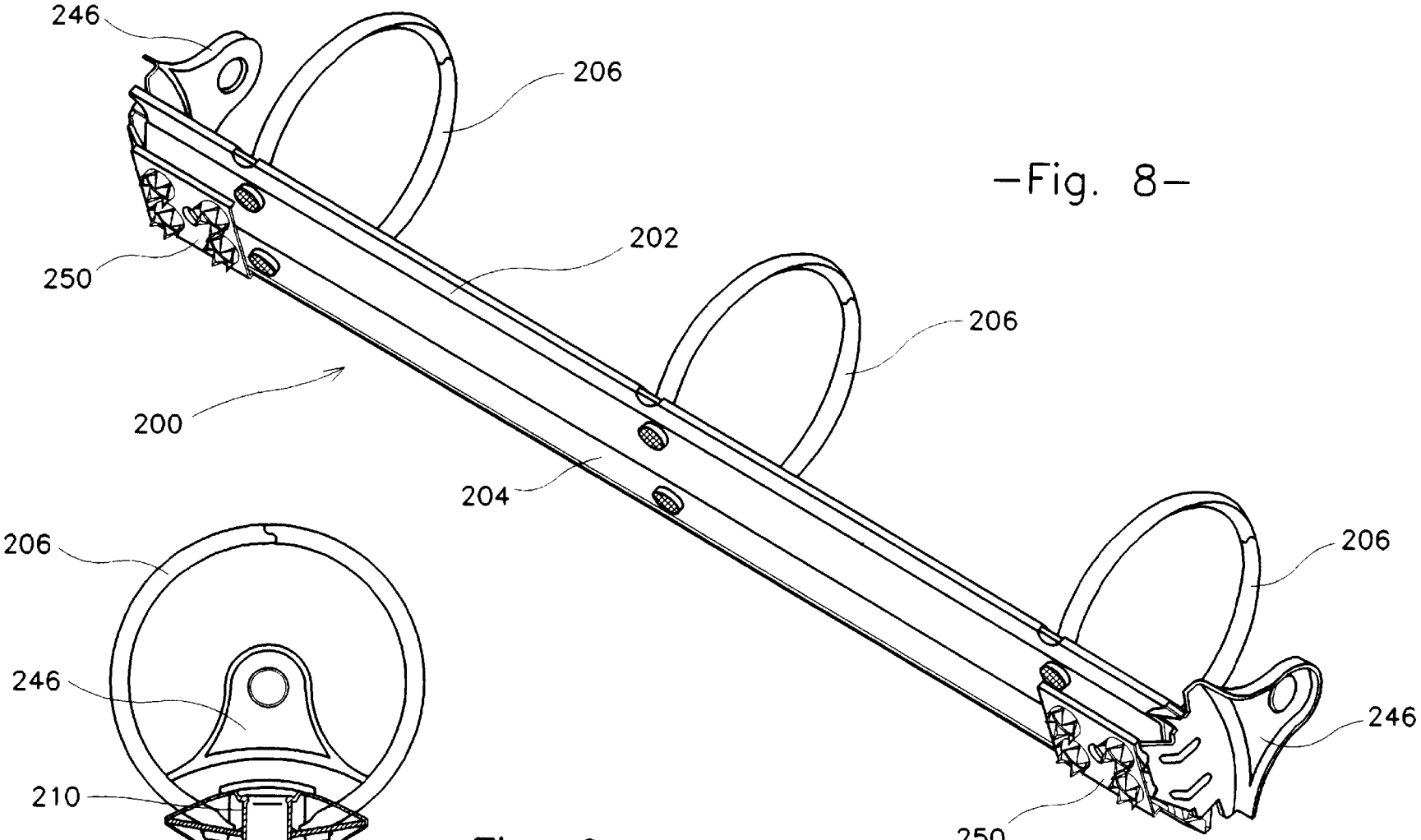
—Fig. 8—
—Fig. 9—

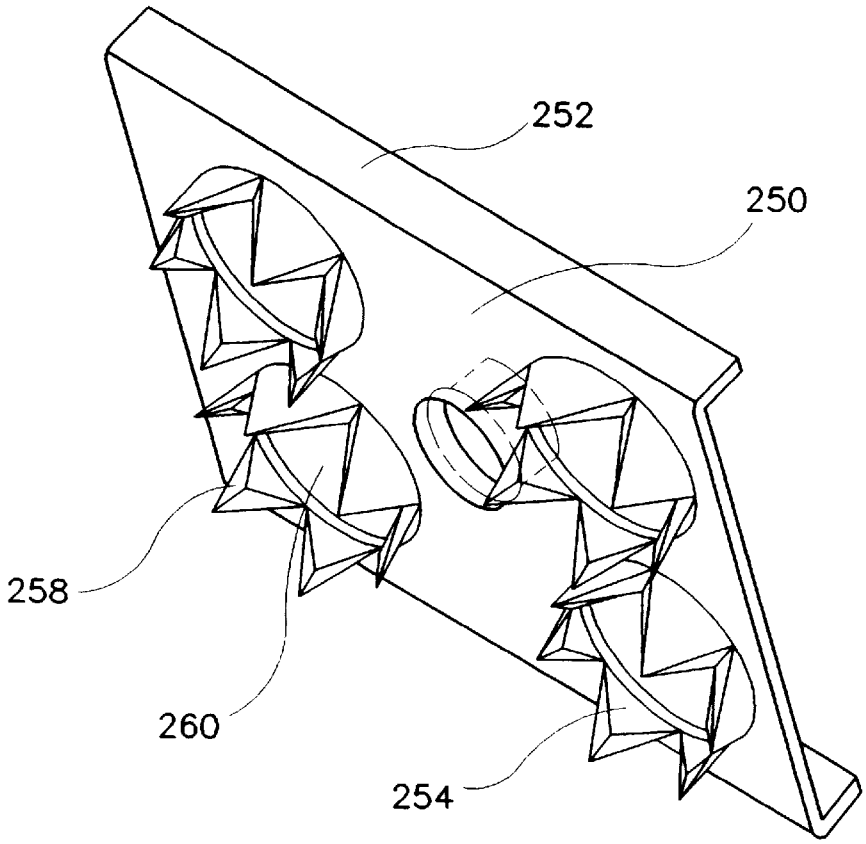
—Fig. 10A—
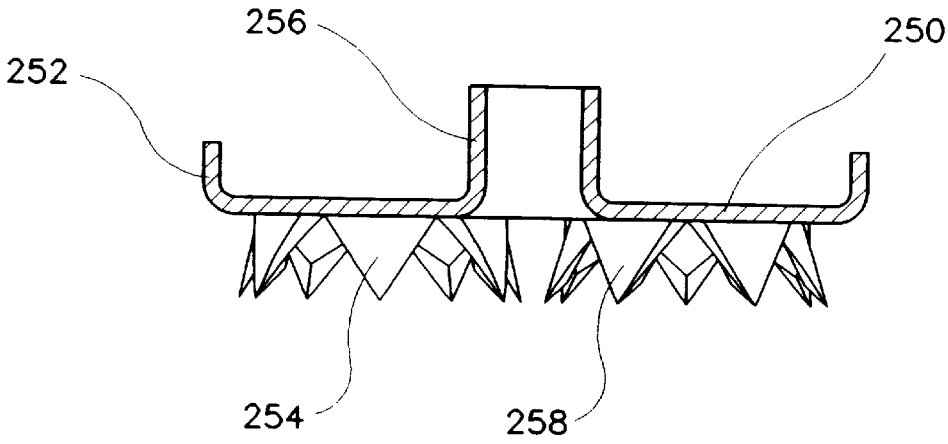
—Fig. 10B—

RING BINDER

This invention relates to a ring binder and, in particular, a ring binder adapted to be secured by at least one rivet to a base member such as a cover.

Conventionally, a ring binder is securable to a cover by a rivet having a head portion for engagement with the cover and a tail portion which is deformable to engage a recess in the upper part of the ring binder.

A disadvantage associated with such a conventional ring binder is that as the rivet is relatively long, shaking and/or wobbling of the ring binder relative to the cover may occur and the connection between the rivet and the cover may therefore be loosened. If, during the assembly of the ring binder to the cover, the punching action necessary to deform the tail portion of the rivet onto the recess in the upper part of the ring binder is not accurately or properly carried out, the upper part of the ring binder may be damaged. If the rivet is too long, its tail portion may, after punching, extend beyond the recess and thus hurt, e.g., the hands of a user. To cope with covers of different sizes made of the same material, rivets of different sizes have to be provided to the assembling factories. This is both laborious and prone to errors.

It is therefore an object of the present invention to provide a ring binder wherein the aforesaid shortcomings are mitigated.

According to the present invention, there is provided a ring binder adapted to be secured to a base member by at least one securing member, which ring binder comprises a substantially rigid upper structure supporting a pivotable lower structure to which a plurality of ring members are mounted, and at least one engagement means engageable with one of the securing members to secure the ring binder to the base member, characterized in that the securing member is engageable with the engagement means closely adjacent to the base member.

With a ring binder made in accordance with the present invention, it is possible to provide only a standardised member rivet for each type of ring binder and it is also possible to provide the assembling factories with ring binders with pre-assembled rivet-engagement means such that it will be a relatively simple procedure to assemble the ring binder to the cover.

The invention will now be described by way of example only and with reference to the accompanying drawings wherein:

FIG. 1A shows a partial sectional view of a conventional ring binder secured to a cardboard or plastic cover;

Fig. 1B shows a partial sectional view of the conventional ring binder secured to a metal cover;

FIG. 2A shows a partial sectional view of a ring binder according to the present invention with a first type of engagement means secured to a cardboard or plastic cover;

FIG. 2B shows a partial sectional view of the ring binder shown in FIG. 2A secured to a metal cover;

FIG. 3A shows a longitudinal sectional view of the first type of engagement means shown in FIGS. 2A and 2B;

FIG. 3B shows an underside perspective view of the engagement means shown in FIGS. 2A to 3A;

FIG. 4 shows a longitudinal sectional view of a second type of engagement means according to the present invention;

FIG. 5 shows an exploded view of a ring binder according to the present invention with a metal cover;

FIG. 6 shows an underside perspective view of the ring binder shown in FIG. 5, duly assembled;

FIG. 7 shows an exploded view of a ring binder according to the present invention with a cardboard or plastic cover;

FIG. 8 shows an underside perspective view of the ring binder shown in FIG. 7, duly assembled;

FIG. 9 shows a partial sectional view of the assembled ring binder shown in FIG. 8;

FIG. 10A shows an underside perspective view of the rivet shown in FIGS. 7 to 9;

FIG. 10B shows a cross-sectional view of the rivet shown in FIGS. 7 to 10A;

Figure 11A:
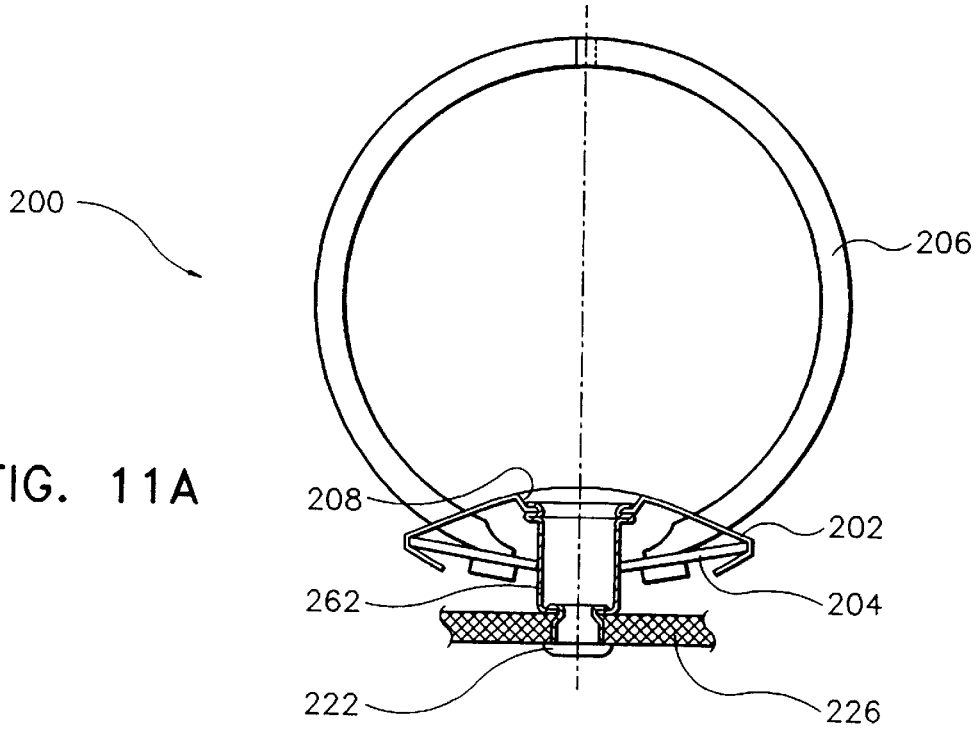
FIG. 11A shows a partial sectional view of a ring binder according to the present invention with a third type of engagement means secured to a cardboard or plastic cover.

As shown in FIGS. 1A and 1B, a conventional ring binder generally designated as 100 comprises a substantially rigid upper structure 102 and a pivotable lower structure 104. Secured to the lower structure 104 are a number of ring elements 106 (partially shown here), such that pivotal movement of the lower structure 104 will bring about corresponding movement of the ring elements 106. Engaged with a depression 108 of the upper structure 102 is an eyelet 110. As shown in FIG. 1A, a rivet 112 secures the ring binder 100 to a base member in the form of a cardboard or plastic (e.g. PVC) cover 114. A tail portion 116 of the rivet 112 is deformed to engage the eyelet 110. As shown in Fig. 1B, a rivet 118 secures the ring binder 100 to a metal cover 120. A tail portion 122 of the rivet 118 is deformed to engage the eyelet 110.

Referring to FIGS. 2A and 2B, a ring binder according to the present invention generally designated as 200 is shown to comprise a substantially rigid upper structure 202 and a pivotable lower structure 204. Mounted to the lower structure 204 are a number of ring elements 206 (partially shown here). Extending substantially downward from and engaged with a depression 208 of the upper structure 202 of the ring binder 200 is an engagement means in the form of a barrel 210.

As shown more clearly in FIGS. 3A and 3B, the barrel 210 includes a cylindrical body 212 and a narrower upper open end 214 which is deformable, e.g. by punching, to engage the depression 208 (as shown in FIGS. 2A and 2B). The barrel 210 also includes an annular lower end 216 with an opening 218 through which, as shown in FIG. 2A, a tail portion 220 of a rivet 222 is received and subsequently deformed to engage the inner surface 224 of the annular lower end 216 of the barrel 210 to thereby secure the ring binder 200 to the cardboard or plastic cover 226. In a similar manner and as shown in FIG. 2B, a tail portion 228 of a rivet 230 is received through the opening 218 and subsequently deformed to engage the inner surface 224 of the annular lower end 216 of the barrel 210 to thereby secure the ring binder 200 to a metal cover 232. To facilitate production, the barrel 210 is formed in one piece with the annular lower end 216.

FIG. 4 shows the longitudinal cross-sectional view of a second type of barrel 234 which may be used in the present invention. The barrel 234 includes a middle cylindrical body 236, a narrower deformable upper open end 238 and a broader annular lower end 240 having a mouth 242. Such a barrel 234 enhances the stability of the ringer binder 200 relative to, e.g., the cardboard or plastic cover 226.

FIG. 5 shows an exploded view of the ring binder 200 with the metal cover 232. Part of the upper structure 202 has been removed to reveal the lower structure 204. The lower structure 204 includes an aperture 244 for receiving therethrough the barrel 210. The size of the aperture 244 is such that the barrel 210 does not hinder the pivotal movement of the lower structure 204. The metal cover 232 includes two holes 248 each for receiving therethrough the respective rivet 230. It is clear from As shown clearly in FIG. 6, the barrels 210 extend from the upper structure 202 and through and beyond the lower structure 204.

As shown in FIGS. 7, 8 and 9, a claw-rivet 250 may be used in place of the rivet 222 or 230. As shown more clearly in Figs. 10A and 10B, the claw-rivet 250 includes a pair of flanges 252, four sets of claws 254 and an upstanding head 256 which is deformable to engage the barrel 210. Each set of claws 254 includes a number of downwardly-pointing pointed elements 258, each in the form of a substantially arcuate sector, arranged along the circumference of a circular orifice 260 on the claw-rivet 250.

Figure 11B:
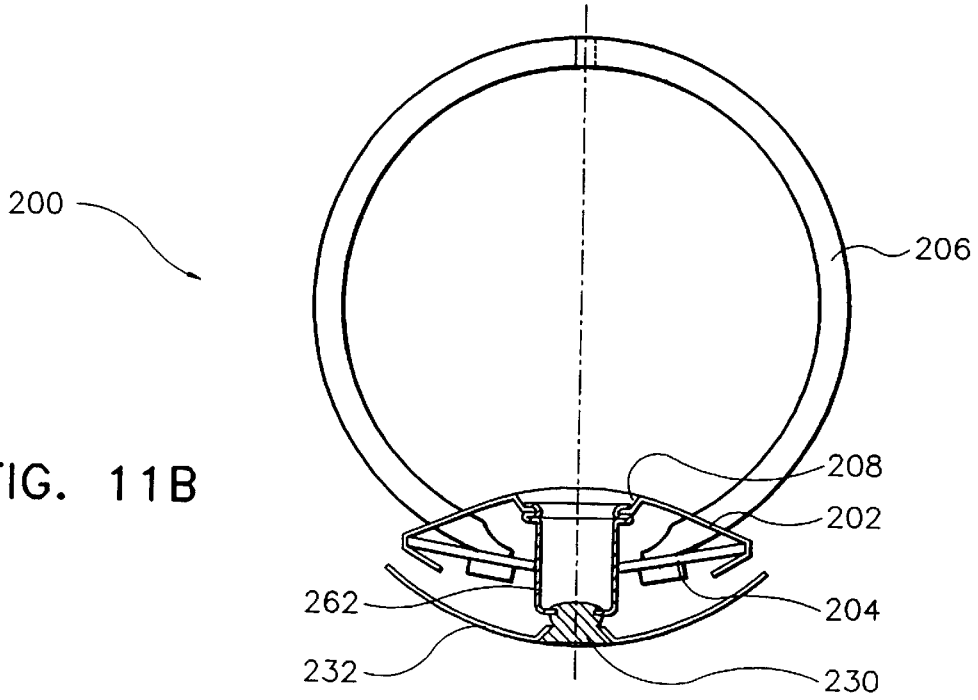
FIG. 11B shows a partial sectional view of the ring binder shown in FIG. 11A secured to a metal cover.
Figure 11C:
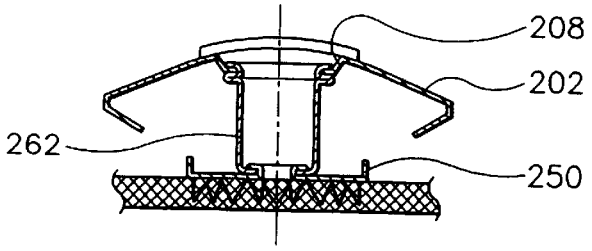
FIG. 11C shows a partial sectional view of the ring binder shown in FIGS. 11A and 11B (with the ring members and lower structure removed for clarity purposes) secured, via the rivet shown in FIGS. 7A to 10B, to a cardboard or plastic cover.

Referring to FIG. 11A, a ring binder 200 according to the present invention is shown as secured via a rivet 222 and a third type of barrel 262 to a cardboard or plastic cover 226. The ring binder 200 is shown in FIG. 11B as secured via a rivet 230 and the barrel 262 to a metal cover 232. FIG. 11C shows the ring binder 200 as secured via a claw rivet 250 and the barrel 262 to a cardboard or plastic cover.

Figure 12:
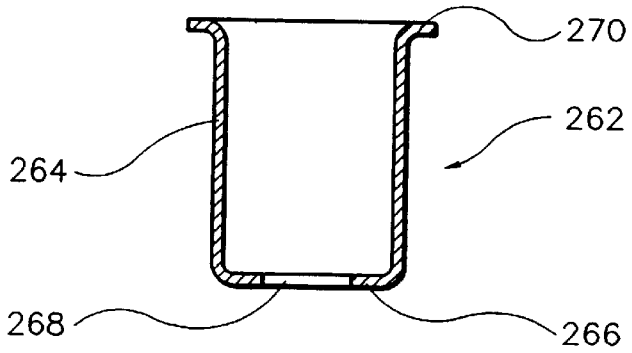
FIG. 12 shows a longitudinal sectional view of the third type of engagement means according to the present invention.
Figure 13A:
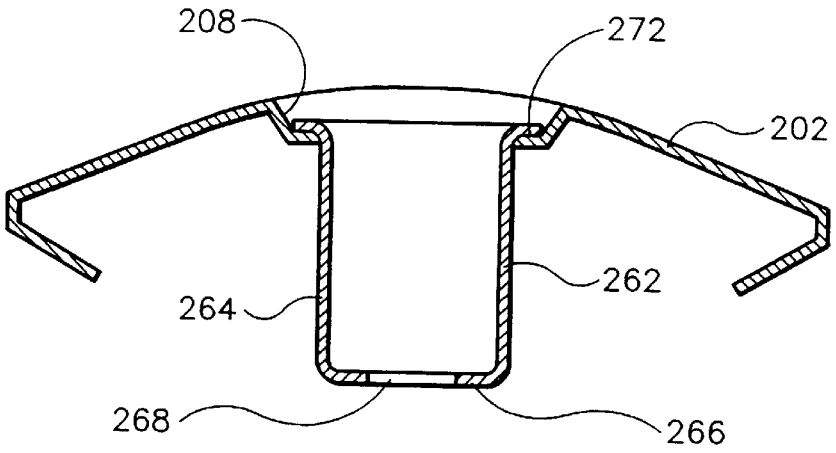
FIG. 13A shows a partial sectional view of the ring binder with the third type of engagement means engaged with the upper structure from above.
Figure 13B:
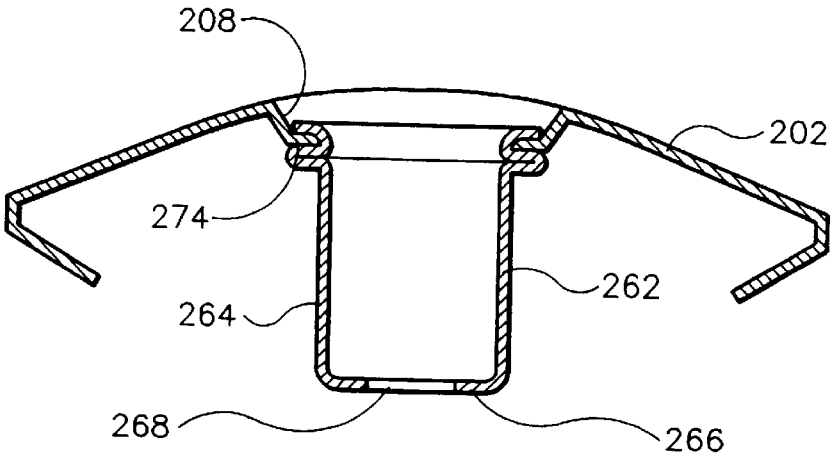
FIG. 13B shows a partial sectional view of the ring binder with the third type of engagement means engaged with the upper structure from both above and below.

Further details of the third type of barrel 262 and its assembly to the upper structure 202 are shown in FIGS. 12, 13A and 13B. As can be seen in FIG. 12, the barrel 262 comprises a substantially cylindrical body portion 264 with an annular base 266 having a central circular opening 268. The barrel 262 has an upper mouth 270 which is wider than the cylindrical body portion 264. The upper mouth 270 may be deformed to engage with the recess 208 of the upper structure 202 of the ring binder.

As shown more clearly in FIGS. 13A and 13B, the assembly of the barrel 262 to the ring binder 200 involves first deformation of the upper mouth 270 to engage the upper surface 272 of the depression 208. The barrel 262 is subject to further compression force such that the cylindrical body 264 adjacent the lower surface 274 of the depression 208 is bulged outward and thereby to engage with the lower surface 274 of the depression 208.

Figure 14:
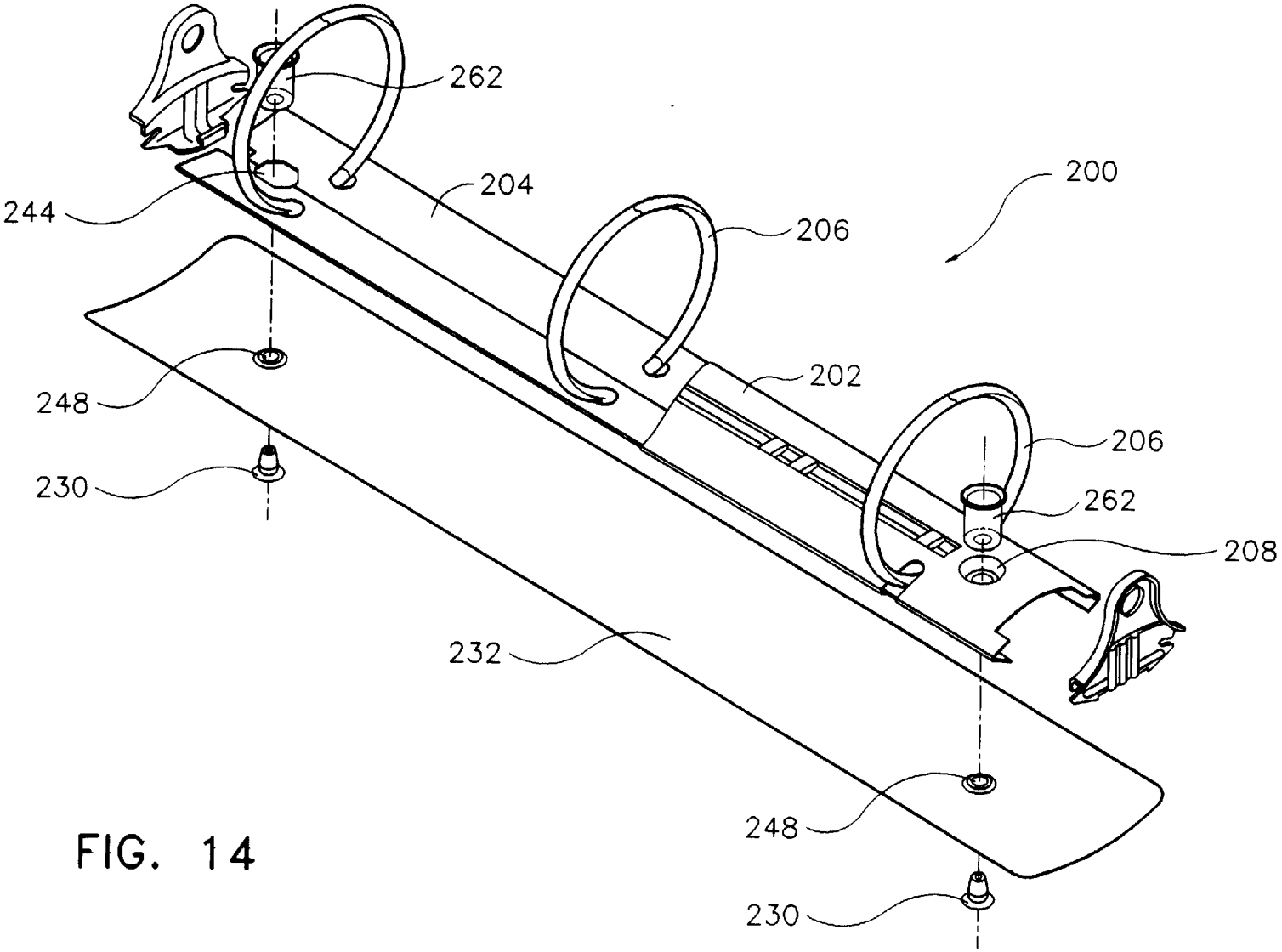
FIG. 14 shows an exploded view of a ring binder according to the present invention with the third type of engagement means and a metal cover.
Figure 15:
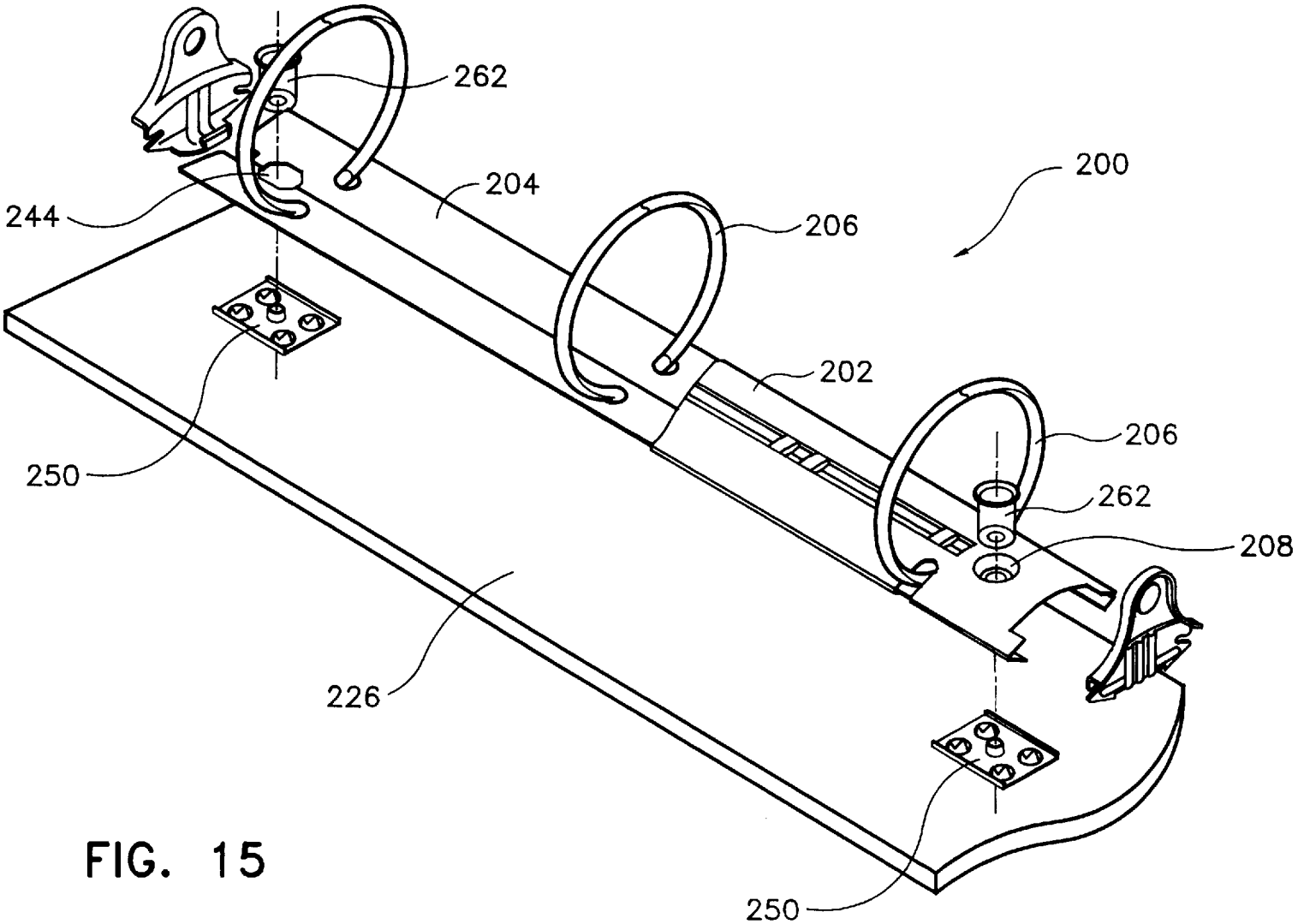
FIG. 15 shows an exploded view of a ring binder according to the present invention with the third type of engagement means, rivets shown in FIGS. 7A to 10B, and a cardboard or plastic cover.

FIGS. 14 and 15 show in more details the assembly of the ring binder 200 via barrels 262 and rivets 230 or claw rivets 250 to a metal cover 232 or a cardboard or plastic cover 250.

The barrels shown in FIGS. 2A to 15 all secure the rivet members closely and/or substantially adjacent the cover. Each barrel has a length which is greater than the length of the rivet.

It should be understood that the above describes only an example for carrying out the present invention and that various modifications may be made without departing from the spirit of the invention.

I claim:

1. A ring binder adapted to be secured to a base member, said ring binder comprising at least one securing member;

a substantially rigid upper structure;

a pivotable lower structure supported by said upper structure;

a plurality of ring members mounted to said lower structure; and at least one engagement means engageable with said securing member closely adjacent to said base member to secure said ring binder to said base member;

wherein the length of said engagement means is greater than the length of said securing member, and wherein said engagement means includes an engagement surface for engaging said securing member, said engagement surface comprising an upper surface of a partially open lower end of said engagement means, and said engagement means comprising a body which is narrower than said partially open lower end.

2. A ring binder according to claim 1 wherein said partially open lower end is integrally formed with said engagement means.

3. A ring binder according to claim 1 wherein said engagement means is deformable to engage with said upper structure.

4. A ring binder according to claim 1 wherein said partially open end of said engagement means abuts against said base member when said ring binder is secured to said base member.

5. A ring binder according to claim 1 wherein said securing member comprises a plurality of riveting elements penetrable into said base member to secure said ring binder to said base member.

6. A ring binder according to claim 5 wherein said riveting elements comprise a plurality of pointed members.

7. A ring binder adapted to be secured to a base member, said ring binder comprising at least one securing member at least partly penetrable into said base member to secure said ring binder to said base member;

a substantially rigid upper structure having a recess, said recess having an upper surface and a lower surface;

a pivotable lower structure supported by said upper structure;

a plurality of ring members mounted to said lower structure; and at least one engagement means engageable with said securing member closely adjacent to said base member, said engagement means being deformable to engage said upper surface and said lower surface of said recess.

8. A ring binder according to claim 7 wherein said engagement means comprises an engagement surface for engagement with said securing member.

9. A ring binder according to claim 8 wherein said engagement surface is provided by an upper surface of a partially open lower end of said engagement means.

10. A ring binder according to claim 9 wherein said partially open lower end abuts said base member when said ring binder is secured to said base member.

11. A ring binder according to claim 7 wherein said securing member comprises a plurality of riveting elements penetrable into said base member to thereby secure said ring binder to said base member.

12. A ring binder according to claim 11 wherein said riveting elements comprise a plurality of pointed members.

* * * * *